US008672505B1

(12) United States Patent
Hogan

(10) Patent No.: US 8,672,505 B1
(45) Date of Patent: Mar. 18, 2014

(54) SOLAR POST AND PILE COVER

(76) Inventor: Hogan M. Hogan, Phoenix, AZ (US)

( * ) Notice: Subject to any disclaimer, the term of this patent is extended or adjusted under 35 U.S.C. 154(b) by 300 days.

(21) Appl. No.: 13/011,887

(22) Filed: Jan. 22, 2011

Related U.S. Application Data

(60) Provisional application No. 61/297,689, filed on Jan. 22, 2010.

(51) Int. Cl.
*F21L 4/00* (2006.01)

(52) U.S. Cl.
USPC ..... 362/183; 362/182; 362/431

(58) Field of Classification Search
USPC ..... 362/183, 431, 363, 184, 249.02, 186, 362/182
See application file for complete search history.

(56) References Cited

U.S. PATENT DOCUMENTS 3,339,065 A * 8/1967 Kelley, Jr. ..... 362/363
4,626,852 A 12/1986 Dodge
4,841,416 A * 6/1989 Doss ..... 362/183
5,362,267 A 11/1994 Forrest
6,021,614 A 2/2000 Krieger
D444,584 S 7/2001 Landefeld
D563,254 S 3/2008 Moore
D590,086 S 4/2009 Laporta
7,744,248 B2 * 6/2010 Kobinata et al. ..... 362/249.02
7,887,214 B2 * 2/2011 Chang et al. ..... 362/183
8,292,452 B2 * 10/2012 Ko ..... 362/183
8,382,347 B2 * 2/2013 McCanless ..... 362/431
2002/0148183 A1 10/2002 Grant
2008/0074867 A1 * 3/2008 Chen ..... 362/183

* cited by examiner

*Primary Examiner* — Robert May
(74) *Attorney, Agent, or Firm* — The Luther Law Firm, PLC; Barbara J. Luther

(57) ABSTRACT

A solar powered, illuminated harbor post and pile cover is disclosed that protects a pile from deterioration, prevents bird roosting and droppings as well as other debris, and variably illuminates, beautifies and makes more interesting docks in a harbor. The invention consists of at least one transparent conical cover superimposed over a second base or post cover wherein the interior electronics and LED's are sealed against the environment, weather and other deteriorating elements, yet is simple in manufacture, design, assemblage and repair.

6 Claims, 9 Drawing Sheets

SOLAR POST AND PILE COVER

This application is a follow on to the Provisional Patent Application of the same title, Ser. No. 61/297,689, filed 22 Jan. 2010.

BACKGROUND OF THE INVENTION

1. Field of the Invention

The invention relates to a post cover and protector of varying shapes and size requirements, and specifically to such caps/covers that illuminate by means of solar power.

2. Description of the Prior Art

Most marina and dock owner/operators use pile caps to protect the top of pilings that secure the docks that aid in accessing vessels. The top of pilings, regardless of construction material, e.g. wood or cement, are subject to weather deterioration, ablation, and discoloration as well as bird fowling. A long-term exposure to such harmful matters will degrade the pilings structural integrity and lend to a less attractive structure.

Common piling caps have been either flat, cylinder, or cone shaped devices. The flat caps cover the top of a piling from harsh marine environments; however, the flat surface allows for birds to rest on top and the result is considerable amounts of bird fowling matter. The cone pile cap provides protection from internal rot and it prevents birds from roosting. The cone shapes also result in a slope that allows moisture and other such matter to flow off the top and not collect on the top.

One example of a protective pole cap is illustrated in U.S. Pat. No. 6,021,614 of inventor Krieger where an cylindrical hat shaped cover is disclosed with a flat top. Finger projections are distributed around the internal periphery for ease in installation to hold the cover in place yet allowing said cap to be removed if desired. The flat shaped head of course provides an undesirable resting and roosting place for foul to make their deposits.

In U.S. Pat. No. 5,362,267 of Forrest, cylinder shaped solar powered, illuminated buoy is disclosed and suggested that said buoy could also be mounted atop a pole. However, the device is not shaped nor designed in a manner that the illuminated device could also act as pole or pile cover.

In another U.S. Pat. No. 4,626,852 of Dodge, another illuminated buoy that is suggested in the manner of a lantern with a clear lens protective cover is disposed over a solar panel. The supporting structure of this device, however, is a bit complex and costly to produce.

Another example of a protective cover is provided in US publication 2002/0148183 of Grant wherein square or rectangular shaped box serves as an illuminated pole cover. Said device, however, serves primarily as an enclosed box for a light without any power source. In addition the perfectly flat top provides a perfect place for foul to gather, roost and leave their droppings.

In the US design patent, D590,086 of Laporta, an ornamental piling light device is disclosed; however, the structure thereof provides little protection for the pile on which it may be mounted, and the slightly rounded dome top again provides an undesirable roosting spot for foul.

An example of a pile cover with illuminated properties is listed in US design patent D563,254 by inventor Moore. In said patent, a solar powered pile cap is placed on top of a given pile and provides fair illumination during times of darkness. Although this design aims at protecting piles and provides illumination, the solar powered pile cap suffers from a number of disadvantages.

The overall shape of the unit lacks general sleekness and attractiveness. The shape begins at the base and follows upward cylindrically until it reaches the second segment. This second segment is box shaped and poses more angle changes until it reaches the flat top where a square element is inset into a round top. The many different shapes and angle changes, including the bulky design of this patent results in an overall unattractiveness and also provides a roosting platform for birds.

In addition, the unit may only be used in conjunction with round pillars and not any typical square, hexagon, octagon or other polygon shaped pillars.

Yet another disadvantage of the Moore patent design is its flat top. Because the solar cell lays flat and recessed on top of the unit, cell cover is subjected to collection of moisture, bird fowling, bird spoiling, and other foreign matter. The result is not only an unsightly and unsanitary post cover, but also the resultant accumulation of various matter thereon restricts the suns solar rays to penetrate the unit's photovoltaic cell. This blockage limits the recharging of the batteries to power the units lighting capabilities. Such a solar powered piling cap would therefore require regular cleaning and servicing.

Still further, the Moore post cover is not available for use year round and requires at least two exterior parts for seasonal segments of the year. A conversion must take place if the solar-lighted unit is desired during periods of year when solar lighting and weather are acceptable. Other periods of time require a cone shaped filter attachment to convert the post cover to a normal protective cap.

In the Moore patent, a required storage area must be facilitated for the unused exterior part. Secondly, when addressing attachments, there does not seem to be any interchangeability or flexibility in this design. For example, the solar lighted part might not work with another size or shaped cap. Manufacturing a multiple part unit could be very costly. Thirdly, the solar lighted part is exterior in design. This means that the solar cell pack is exposed to the weather elements and must be properly sealed to prevent degradation of vital parts.

Ease of servicing is also an issue. To change expired LED's of the Moore patent, the unit requires disassembly for changing a light, and one must disturb the manufactures sealing of components to gain access to the lighting assembly.

Still other disadvantages of Moore type designs is that the solar powered piling cap lighting capability is poor for several reasons. First, this unit is only designed for partial year use. Therefore the unit's capability to aid in safety is restricted to a specific time of year. Secondly, the resultant light does not meet Coast Guard and International inland requirements to be used as a certified aid to safety. The available light is inefficient to mark hazards or structures. The design requires two lens covers that thereby restrict the output of light. The first lens covers and surrounds the light cluster of LED's, the second lens covers the first lens from the exterior. The design also lacks the ability of flashing per Coastguard, International and Inland requirements to identify hazards in low visibility. Finally, the units lighting configuration fails to provide any creative ornamental appeal in its design.

Finally, in the post top luminaire of US design patent D444,584S, a post top illuminated cover is disclosed but little, if any, post top protection is provided.

SUMMARY OF THE INVENTION

In accordance with a preferred embodiment of the invention, a decorative solar powered pile protector encompasses a transparent cone like shape to cover, shield, and protect a given pile and provide adequate omni directional solar powered LED lighting to perpetually beautify and illuminate boating docks and thereby aid in marine safety.

DESCRIPTION OF A PREFERRED EMBODIMENT

Figure 1:
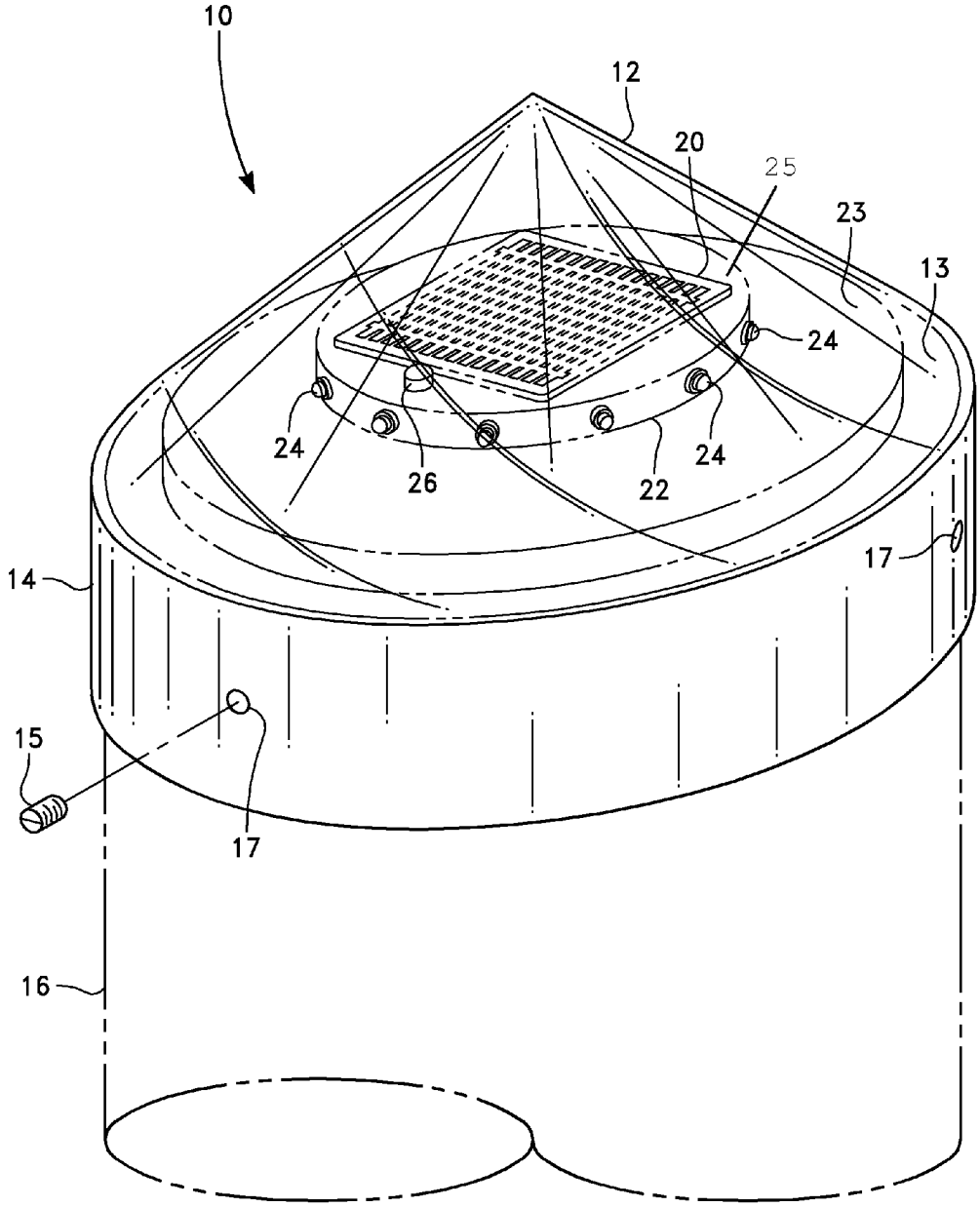
FIG. 1 illustrates a perspective view of the transparent cone invention mounted on a typical post/pile.
Figure 2:
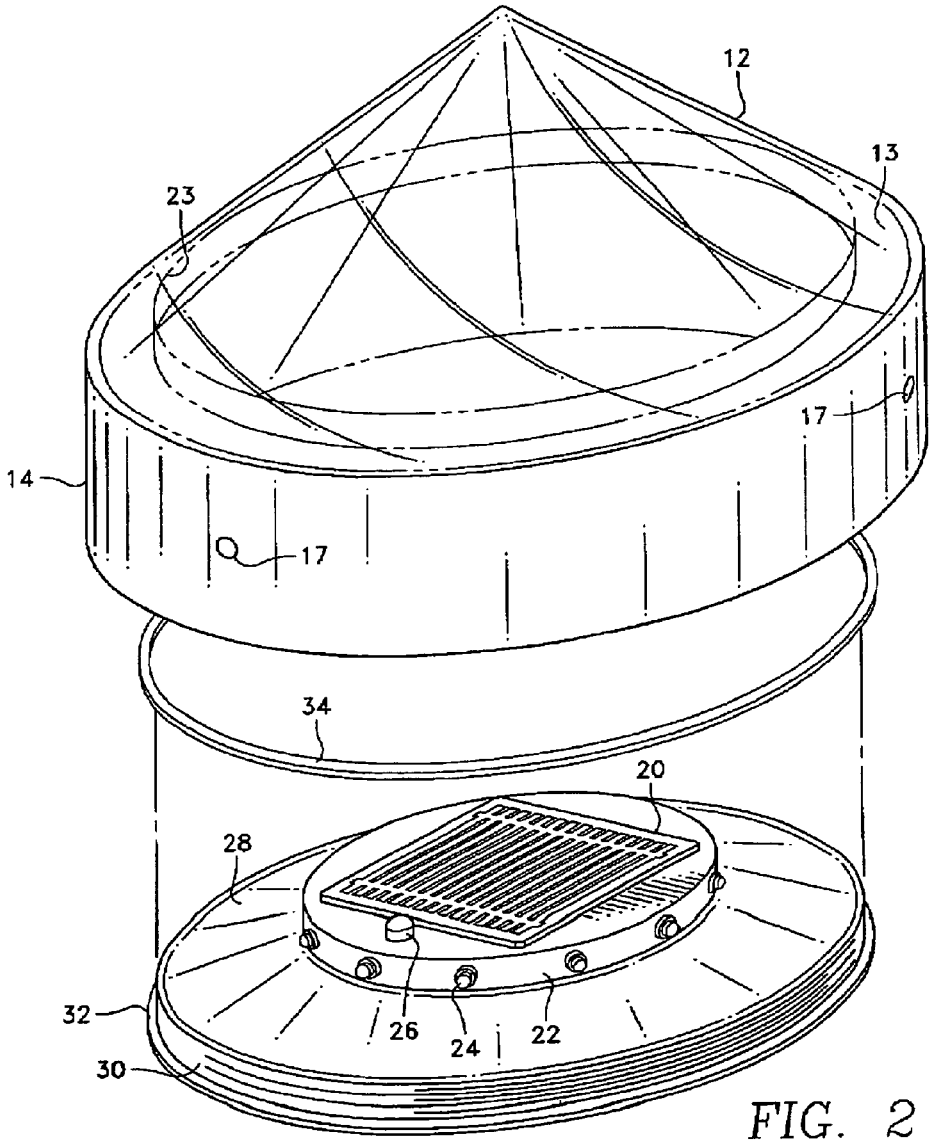
FIG. 2 illustrates an exploded view of the invention in FIG. 1 clearly disclosing the covered and protected solar array.

One preferred embodiment of the solar powered pile protector is illustrated in the perspective views of FIGS. 1 and 2, wherein a pile protector housing 10, high impact resistant, protective UV stabilized, transparent, conically shaped housing 12 is illustrated. Actually pile protector housing 10 consists of two portions: a cone shaped cover 12 that rests upon a cylindrically shaped mounting base 14. The cylindrically shaped mounting base 14, secured by screws 15 in holes 17 to the cone shaped cover 12 is mounted on and rests securely on the top of a given circular ended pile 16 or similar structure. Pile 16 can, of course have a triangular, square, octagonal or other polygon shaped end for which the cylindrically shaped base 14 would be appropriately designed.

Conically shaped housing 12 slopes up to a common conical point. This shape allows for all the foreign matter to diverge off to the sides thereof. The cone shape also prevents bird roosting and helps to prevent exposure to bird fowling and spoiling, therefore avoiding any stationary matter remaining on the cone shaped housing 12 or on the cylindrical base 14. The cone portion is preferably a clear and transparent section to interface with the solar service pack 22 or solar photovoltaic cells 20. This clear and transparent section allows for the sun's solar rays to penetrate the solar photovoltaic cell 20 resting on a circular, electronic service pack 22. Service pack 22 has disposed around it a plurality of LED's 24. Electronic service pack 22 rests upon a circular metallic or plastic reflective disc 23 that in turn rests upon the mounting base 14 mounting cover 12. A photo active light sensor (not shown) and power switch 26 not only has on/off functions but also steady and blinking function for the LED's 24. A side 25 is provided on the base cap 20.

During periods of darkness the cone section 12 allows and serves as a lens for the light produced from the LEDs 24 to be visible. The clear cone cover 12 may even be designed to become illuminated to a glowing image by use of a lens optics type cone top. The water tight housing 10 is produced with a high strength "MilSpec" polypropylene, polycarbonate, Acrylic or other related material sufficient to be able to provide collision protection. It is envisioned that many sizes and shapes of housing 10 may be required to protect the tops of different piles. Typical dimensions of housing 10 would be in the realm of 15 inches in diameter, 12 inches in height, with a quarter inch thickness; however, larger and smaller housings 10 are clearly anticipated so measurements given herein are by no means limiting. The exploded view of FIG. 2 more clearly illustrates the foregoing addressed components of FIG. 1, and also illustrates an alternate sloped periphery 28 embodiment of reflective disc 23.

It can be observed that disc 23 is provided with a peripheral threaded edge 30 leading to a sealing lip 32 upon which rests a sealing O Ring 34 that rests between lip 32 and mounting cover 12.

Figure 3:
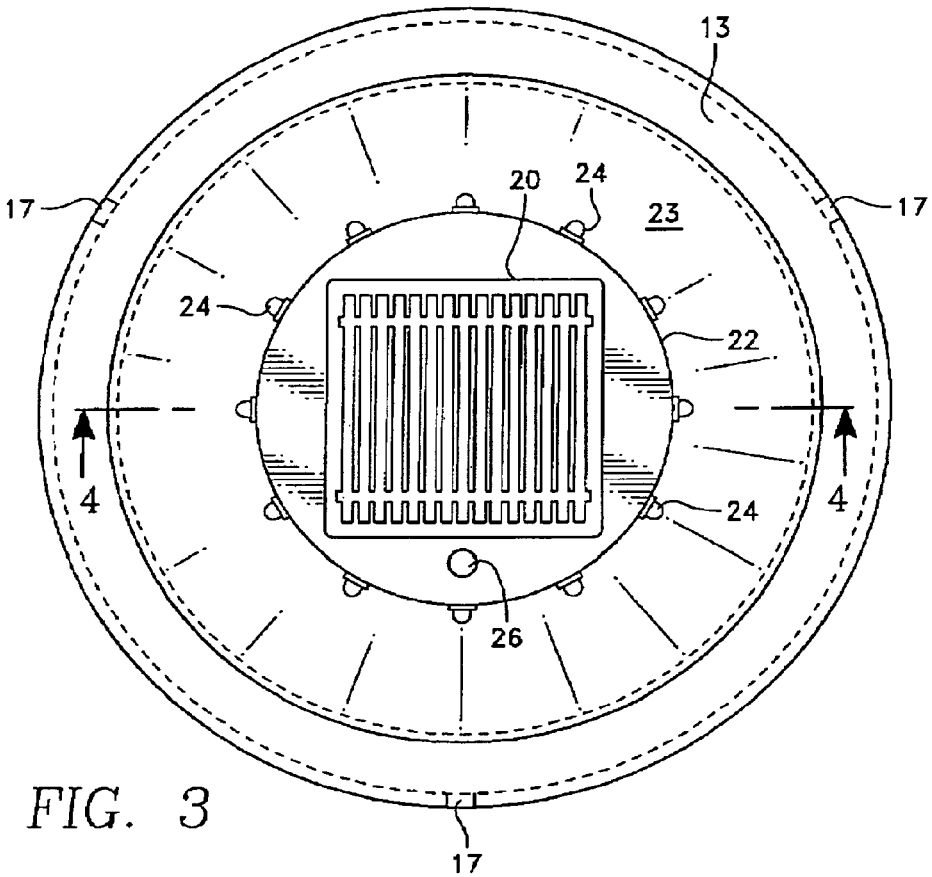
FIG. 3 illustrates a top, plan view of the invention in FIG. 1.
Figure 4:
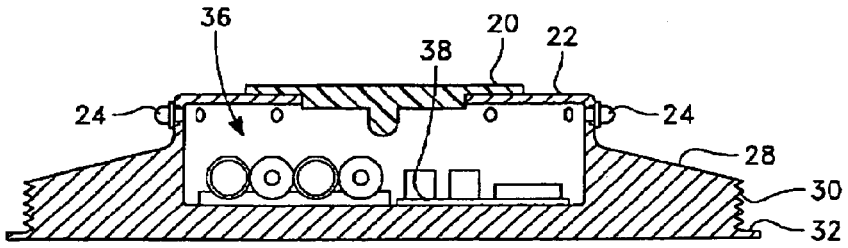
FIG. 4 illustrates an elevation cross section view of FIG. 3

Referring now to FIGS. 3 and 4 wherein a top/plan view, and a sectional view, respectively, are provided such that the electronic service pack 22 may be more conveniently disclosed in the cross section 4 in FIG. 3. FIG. 4 discloses a series of rechargeable batteries 36 coupled to a printed circuit board (PCB) 38 that contains appropriate state of the art electronic components (not shown) to perform illuminating functions of on/off, solar charging of the battery pack 36, LED steady or blinking as encoded and as desired manually or electronic sensor settings.

Figure 5:
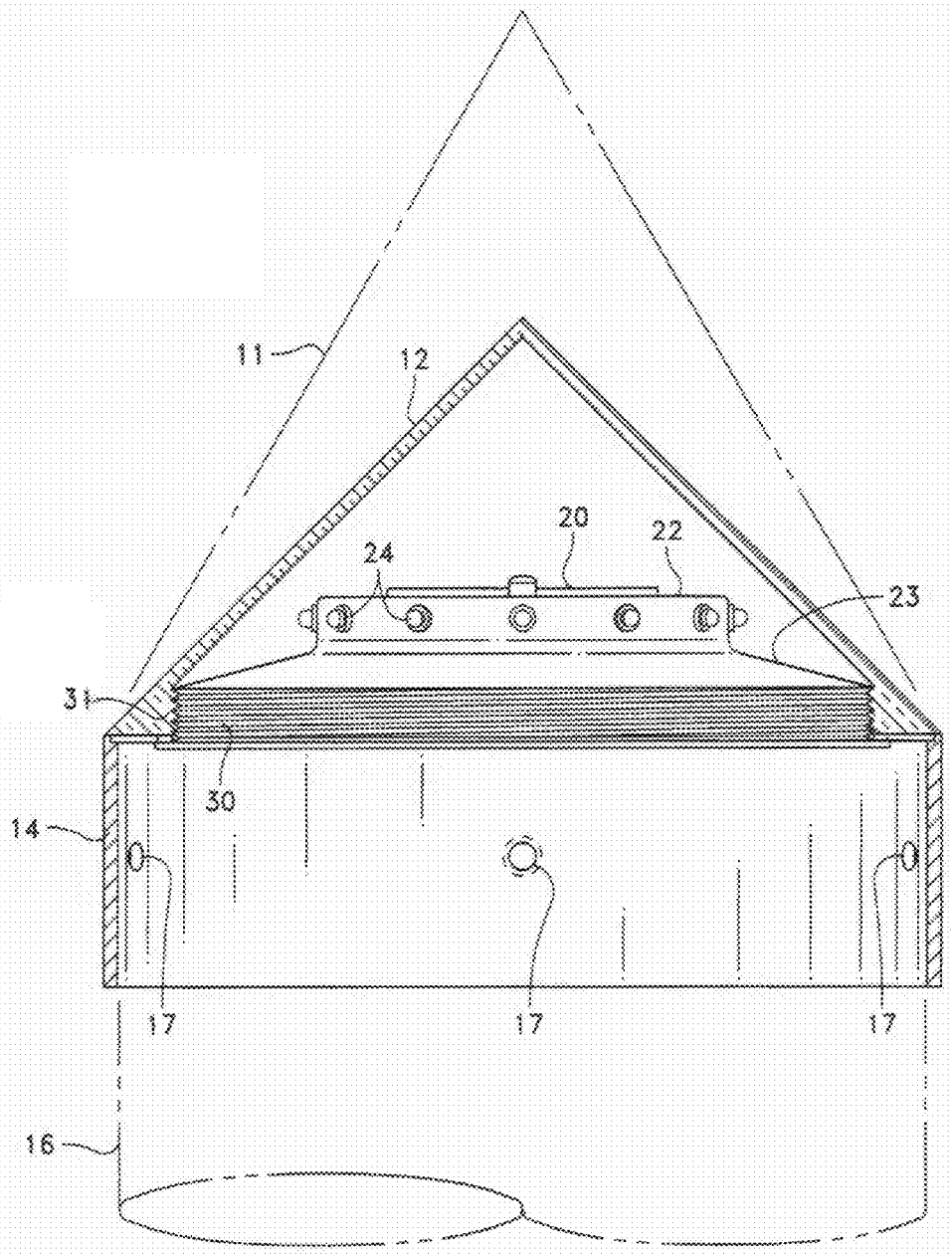
FIG. 5 illustrates an elevation cross section of FIG. 1 with an alternate or additional transparent cone cover.
Figure 6:
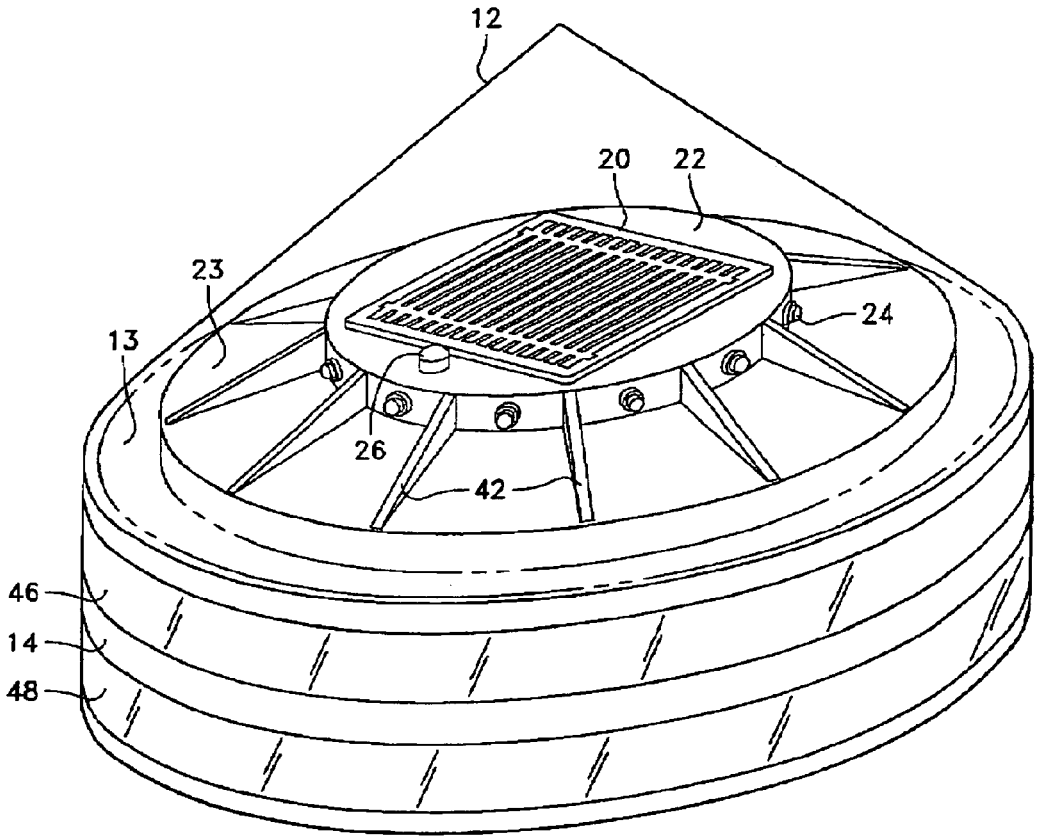
FIG. 6 illustrates a perspective view of an alternate embodiment of the invention with light directed flanges, LED's, and reflective tape bands.

FIGS. 3 and 4 show the solar service pack 22 which is a single unit consisting of the solar photovoltaic cells 20, replaceable LEDs 24, clear divisional vanes 42 of FIG. 6, threaded areas 30 and 32 of FIGS. 4 and 5, and reflective surface 23. The photovoltaic cell 20 is located on top of the structure to gain exposure to the sun's solar rays. A photocell that is connected to a relay switch is integrated in the center of the photovoltaic cell to operate when ambient light drops below a given value to act as a low voltage disconnect. The replaceable LEDs 24 are spaced equally 360 degrees around the base of the photovoltaic cell 20.

The horizontal positioning of the LEDs 24 provides maximum illumination effectiveness and vertical divergence outward around the unit. To support the rise of the photovoltaic cell 20 and the LEDs 24 in the center are transparent divisional vanes 42 illustrated in FIG. 6. The divisional vanes 42 also provide a nautical character accent to the invention.

To access the solar service pack 22, the unit may be unscrewed by rotating the reflecting element 23 counter clockwise due to its threaded or interlock area 30/32. Likewise reattaching the solar service pack 22 to the housing may be done by matching the two threaded or interlock areas and rotating clockwise.

The outer area on the top surface surrounding the solar cell is the reflective surface 23. The reflective top surface 23 allows the light produced by the LEDs 24 to reflect upwards to the top of the clear cone shaped cover 12. This illumination of the cone shaped cover 12 portion provides an ornamental character in addition to its designed safety features. Again FIG. 4 shows the internal detail of the electrical components of the rechargeable batteries, switch, relay, and photocell.

Fitting between the solar service pack 22 and the housing 12 is a silicon or rubber weather O-ring seal 34 as shown in FIG. 2. The weather seal integrated within the threaded area 30/32 of solar service pack 22 helps to protect the PCB 38 and other electronic components from the elements. By placement of weather O-ring seal 34 between cone shaped cover 12 and mounting base 14, an airtight barrier is created between the housing cover 10 and the solar service pack 22.

It is envisioned that an optional color insert, not illustrated, may be used. A transparent "colored" 360-degree film could rest around the photovoltaic cell 20 and on top of the reflective surface 23. The color insert's position in front of the LEDs 24 would allow light to travel through the given insert to produce a desired color. The color insert would have equally spaced slits to match each of the divisional vanes 36 for a secure fit.

Figure 7:
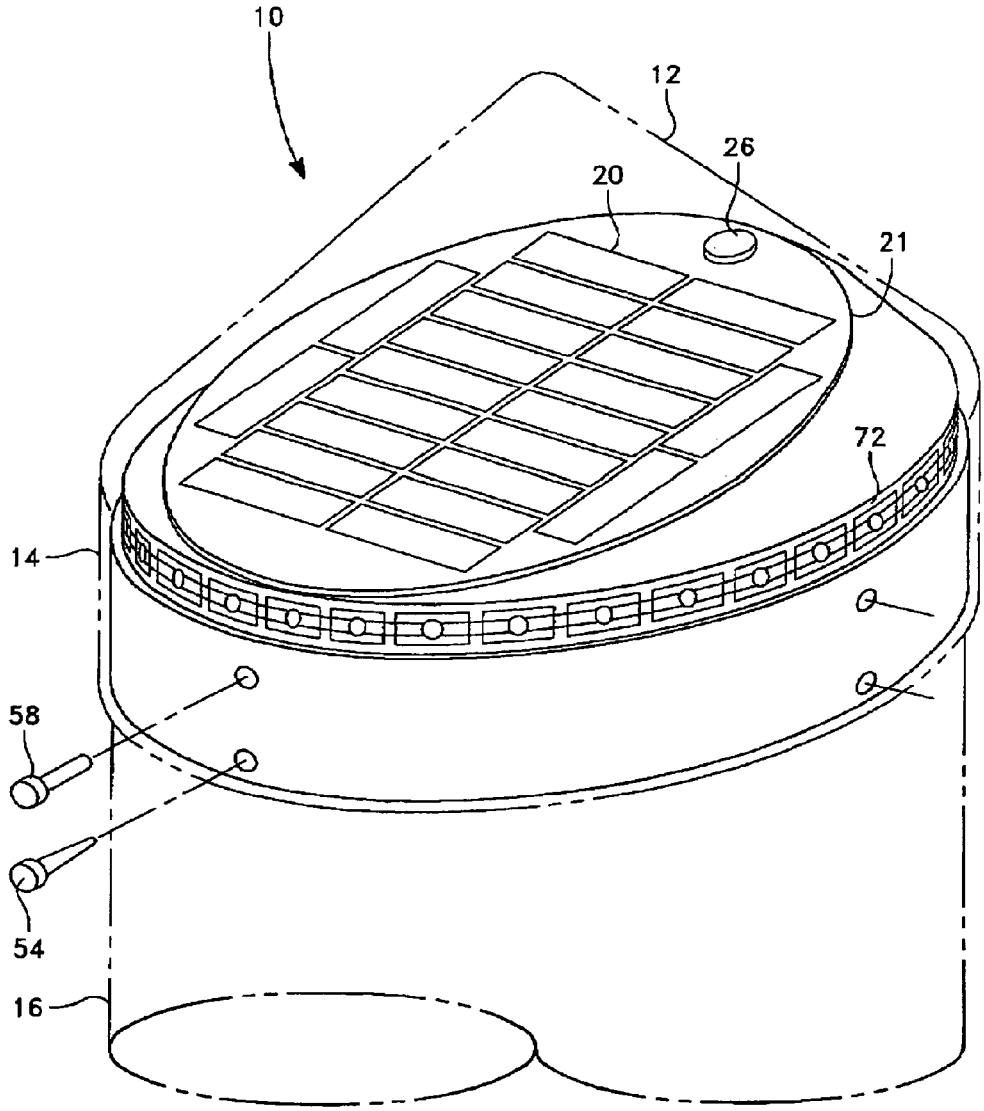
FIG. 7 depicts a perspective view of another alternate embodiment of the invention with a larger and inclined, protective solar panel array.
Figure 8:
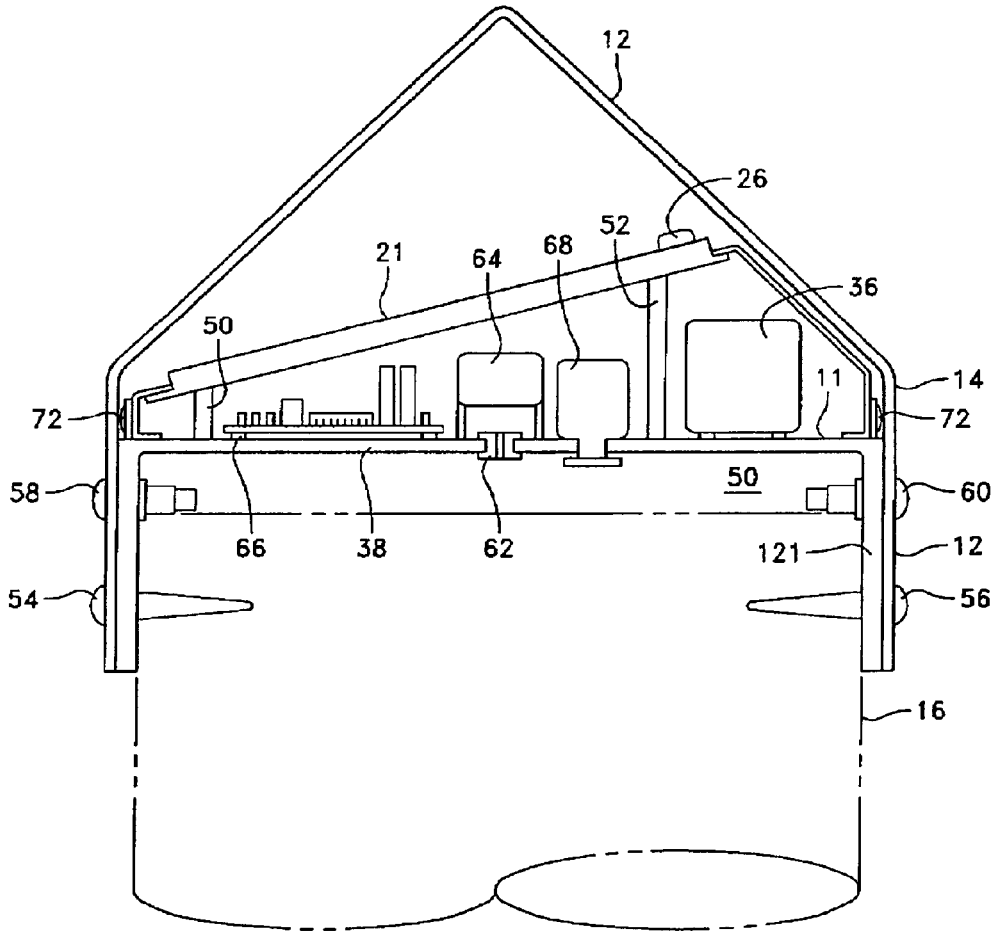
FIG. 8 illustrates an elevation view of FIG. 7 illustrating the inclined solar array protecting the PCB and electronics thereon.
Figure 9:
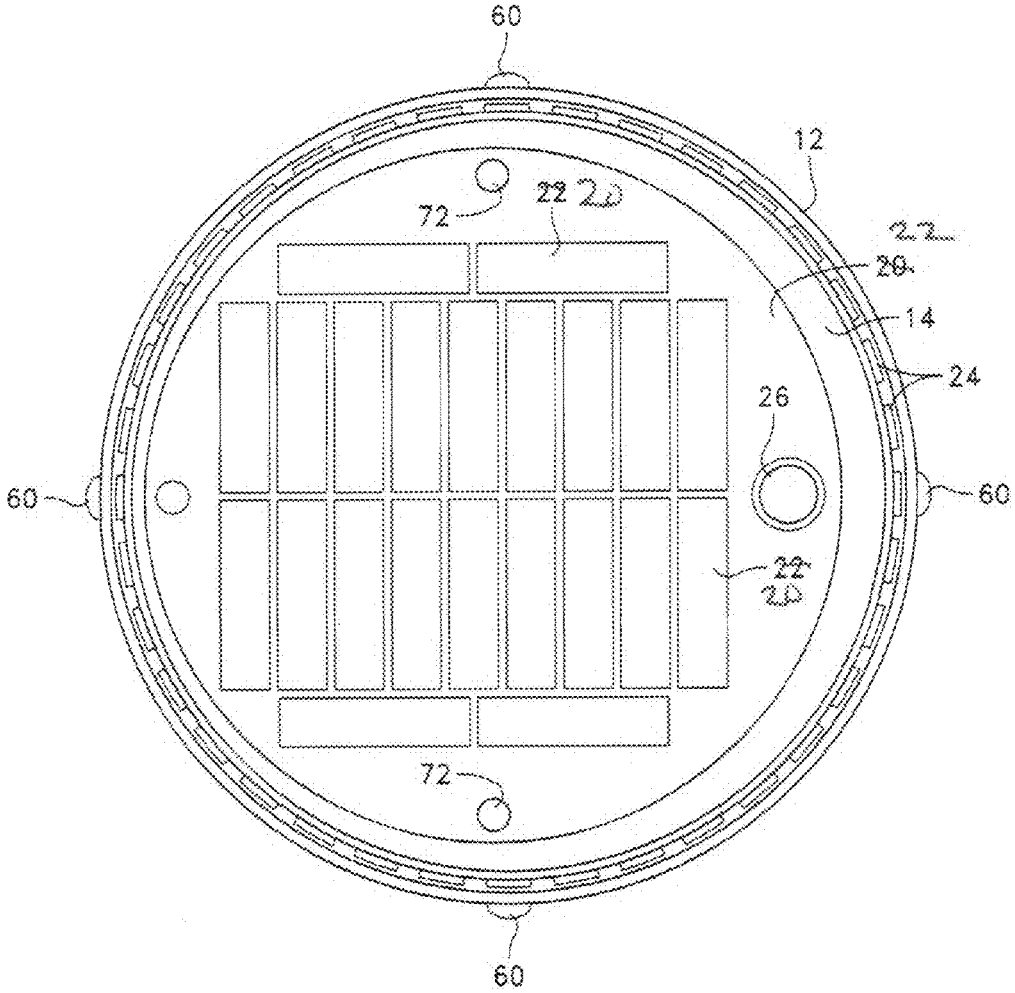
FIG. 9 is a plan top view of FIG. 7.

Referring now to FIGS. 7, 8, and 9, a slightly different embodiment of the invention is envisioned for simplicity and efficiency of manufacture as well as implementation and service of the device.

In FIG. 7, a two cap system is envisioned. Again, a clear cone shaped cover 12 is made of shock proof, UV balanced, acrylic plastic and that extends as a cylinder head base 14 to snuggly fit over the head of a piling 16. The solar panel array 20, however, is much larger than previous embodiment and can thereby generate larger amounts of energy faster to recharge a larger and therefore longer life battery 36. The photo active power switch 26 is positioned in similar manner adjacent the photovoltaic cells 20. The photovoltaic cells 20 on an individual board, however, is seen to be mounted on support posts 50 and 52 so that the PCB sitting at an incline cover over the PCB 38 to further protect fragile electronic components thereon and to allow said electronics to have a breathing room and more convenient access to repair. The panel array 20 is also elevated above the base bottom 11 of housing 10 providing a protective open area 50 between pile 16 and housing 10.

The basic advantage of the two cap pile cover consisting of transparent cylindrical cone 12 that more conveniently fits over a separate pile cover base 121 that in turn is mounted above the pile 16 is ease of access to the electronic components on PCB 38 and greater ability to allow heat generated therein to dissipate as well as well as efficiency of manufacture, and protecting electronic components therein.

Assemblage and disassembly of this embodiment of the invention starts with covering the pile 16 with first base cap 121 securely attached via hex secure screws 54 and 56 and then mounting second cone cover cap 12 over the first cap 121 and securing each cap together via screws or through bolts 58 and 60.

PCB 38 is further provided additional safety and weatherproofing via an over pressure temperature relief valve 62 and a desiccant element 64. It will be noted that PCB 38 is further allowed to ventilate via mounting risers 66. A multi-position rotary switch 68 serves to set the flexible LED ribbon/band 72 to desired steady on/off, full on, quarter brightness, or steady blinking/flashing as also regulated via photo sensitive switch 26.

Referring to FIG. 9, the solar service pack 22 may also be provided with mounting holes 72.

Figure 10:
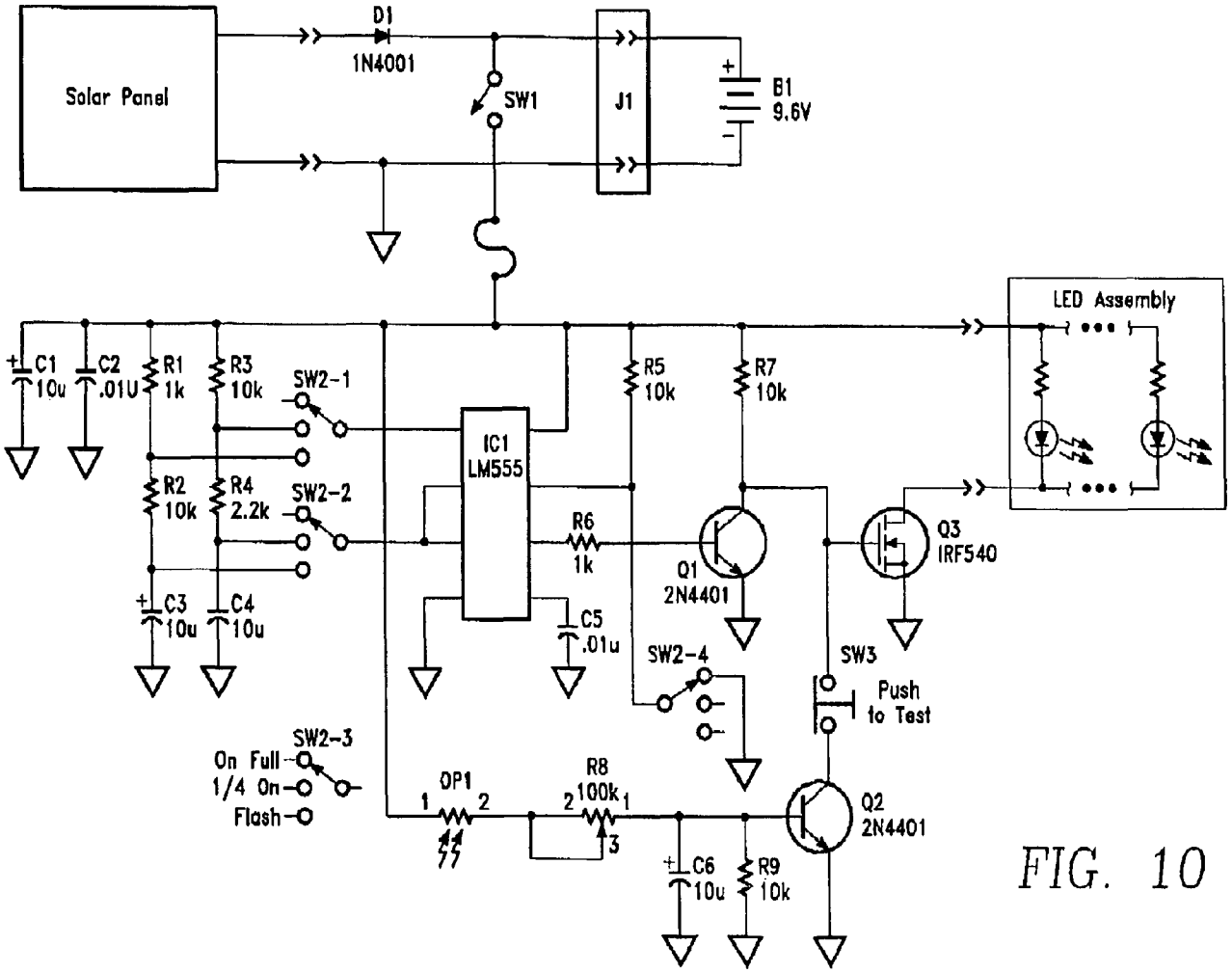
FIG. 10 is an electronic schematic of the PCB of the invention.

FIG. 10 is included with the specification for a complete enabling disclosure of one of a variety of electrical circuits that will make the post, pile protector cap an interesting, decorative, illuminative harbor fixture with several modes of operation and colors.

Operation:

The primary purpose of the solar illuminated piling protector invention is to protect the tops of pilings 16 that are made of wood, cement, etc. The opening of the bottom of the mounting base 14 allows the pile cover to rest securely over the top of a given pile 16. The alternate angular cone cover shape 12 as shown in FIG. 5 diverts all moisture and foreign matter to the sides of the pile 16. Reflective striping 46 and 48 provided in FIG. 6 aids in visibility of a pile and cover during periods of darkness to identify the pile with provided light.

A second purpose of the invention is to provide light in a 360-degree manner as illustrated for safety reasons as well as ornamental aesthetics. Because most dock pilings 16 are exterior and, exposed to the sun for many hours a day, the invention can power the lighting with solar energy. The clear cone 12 segment of the housing allows the sun's rays to pass through the protective cover 12 surface to penetrate the photovoltaic cell 20. Solar energy is stored by means of rechargeable batteries 36. To activate the one of three lighting patterns of the LEDs 24, a four position switch 26 on the solar service pack 22 must be placed in the desired setting. When the ambient light falls below a given value, the photovoltaic cells 20 provide electrical power from the rechargeable batteries 36 for activation.

Conversely when sunrise occurs, the photovoltaic cells 20 act as a low voltage disconnect by sensing the given light value and removing electrical power to the LEDs. With the power supply removed, the rechargeable batteries 36 will gain restored power from the sun's exposure to the photovoltaic cell 20. A steady light pattern illuminates each of the LEDs at a steady lighting interval. A flash light pattern flashes each LED simultaneously 10 times per minute. This light pattern can be used to aid in safety lighting to identify a hazard. Any creative LED lighting pattern may be used in addition to the foregoing for ornamental/entertaining purposes.

Although the description above contains many specifications these should not be construed as limiting the scope of the embodiment but as merely providing illustrations of the same of the presently preferred embodiments. For example, the pile protector may require other shapes, such as square, triangle, and octagon. In addition, drain holes or high-pressure relief may be included to drain any undesired moisture/pressure that may collect inside the protective housing. Also the use of multicolor/water proof LEDs and lens optics/prisms may be used for lighting efficiency. The LEDs may be installed external of the service pack on an electrical board to allow for contact to metal for better cooling. Thus the scope of the embodiment should be determined by the appended claims and their legal equivalents, rather than by the examples given.

What is claimed is:

1. A protective cover assembly to aid in marine safety, comprising: a cone-shaped transparent cover having a cylindrical base;

a circular base platform attached to and sealing an interior volume of the cover, the interior containing
- a reflective disc;
- a switch;
- photovoltaic cells disposed within the cover;
- printed circuit board and at least one rechargeable battery or battery pack; and
- a plurality of lights attached to the batteries and printed circuit board and disposed within the housing and arranged to provide 360 degree light;

the base platform shaped to accommodate the shape of a piling, thereby protecting the piling from the elements and having a waterproof connection with the transparent cover, whereby the cone shape of the transparent cover repels birds to keep the transparent cover clean and the photovoltaic cells and the lights effective; and wherein the cylindrical base of the cone-shaped cover of claim cover is sealed to the circular base platform with an O-ring.

2. A solar powered post and pile cover, comprising:

a. a cone shaped transparent cover housing having a cylindrical base, the housing being UV resistant and sufficiently hard to withstand weather and blows;

b. a first cap with a circular base platform attached to and sealing to the cover housing, the circular base platform comprising
   i. an angled base for photovoltaic cells and a switch;
   ii. printed circuit board under the angled base and set on risers;
   iii. a desiccant element;
   iv. a temperature relief valve in the base platform;
   v. a switch to set the LED lights to steady on/off, full on, quarter brightness or steady blinking-flashing; and
   vi. batteries; and
c. a strip of LED lights attached to the printed circuit board and battery, whereby the angled base for the photovoltaic cells faces the sun for maximum power generation.

3. The solar powered post and pile cover of claim 2, wherein the housing is made of material selected from the group consisting of a high strength polypropylene, polycarbonate or acrylic.

4. A method of providing lighting for navigation, the method comprising:
a) providing solar powered post and pile cover comprising
   i) a cone shaped transparent cover housing having a cylindrical base, the cover housing being UV resistant and sufficiently hard to withstand weather and blows;
   ii) a first cap with a circular base platform attached to and sealing to the cover housing, the circular base platform comprising
   iii) an angled base for photovoltaic cells and a switch;
   iv) printed circuit board electronic components under the angled base and set on risers;
   v) a desiccant element;
   vi) a temperature relief valve in the base platform;
   vii) a switch to set the LED lights to steady on/off, full on, quarter brightness or steady blinking-flashing; and
   viii) batteries; and
   ix) a strip of LED lights attached to the printed circuit board and battery, whereby the angled base for the photovoltaic cells faces the sun for maximum power generation;
b) placing the base platform on top of a post;
c) adjusting the direction of the angled base for the photovoltaic cells for maximum power generation;
d) turning on the LED light switch to steady on/off, full on, quarter brightness or steady blinking-flashing;
e) placing the cover housing over the base platform; and
f) affixing the cover housing and base platform to the piling.

5. A method of providing safety lighting, the method comprising
a) providing a safety lighting assembly, comprising:
   i) a cone-shaped transparent cover having a cylindrical base;
   ii) a circular base platform attached to and sealing an interior volume of the transparent cover;
   iii) photovoltaic cells disposed within the transparent cover;
   iv) printed circuit board and at least one rechargeable battery or battery pack;
   v) a plurality of lights attached to the batteries and electronic components and disposed within the housing and arranged to provide 360 degree light; and
   vi) the base platform sized and shaped to accommodate the shape of a support, thereby protecting the support from the elements and having a waterproof connection with the transparent cover, whereby the cone shape of the transparent cover repels birds to keep the transparent cover clean and the photovoltaic cells and the lights effective;
b) providing a support on which to mount the safety lighting assembly;
c) placing the base platform on top of the support;
d) placing the transparent cover over the base platform; and
e) affixing the base platform and the transparent cover to the support.

6. A method of providing security lighting, the method comprising:
a) providing a security lighting assembly, comprising:
   i) a cone-shaped transparent cover having a cylindrical base;
   ii) a circular base platform attached to and sealing an interior volume of the cover;
   iii) photovoltaic cells disposed within the cover;
   iv) printed circuit board and at least one rechargeable battery or battery pack;
   v) a plurality of lights attached to the batteries and printed circuit board and disposed within the transparent cover and arranged to provide 360 degree light; and
   vi) the base platform sized and shaped to accommodate the shape of a support, thereby protecting the support from the elements and having a waterproof connection with the transparent cover, whereby the cone shape of the transparent cover repels birds to keep the transparent cover clean and the photovoltaic cells and the lights effective;
b) providing a support on which to mount the security lighting assembly;
c) placing the base platform on top of the support;
d) placing the transparent cover over the circular base platform; and
e) affixing the base platform and transparent cover to the support.

* * * * *

UNITED STATES PATENT AND TRADEMARK OFFICE

CERTIFICATE OF CORRECTION

PATENT NO. : 8,672,505 B1
APPLICATION NO. : 13/011887
DATED : March 18, 2014
INVENTOR(S) : Sean M. Hogan It is certified that error appears in the above-identified patent and that said Letters Patent is hereby corrected as shown below:

On the Title Page

Delete the title page and substitute therefore with the attached title page consisting of the corrected illustrative figure(s)

(76) Inventor: Hogan M. Hogan, Phoenix, AZ (US)

corrected to:

(76) Inventor: Sean M. Hogan, Scottsdale, AZ (US)

Signed and Sealed this
Tenth Day of June, 2014

Michelle K. Lee

Michelle K. Lee
*Deputy Director of the United States Patent and Trademark Office*

(12) United States Patent
Hogan

(10) Patent No.: US 8,672,505 B1
(45) Date of Patent: Mar. 18, 2014

(54) SOLAR POST AND PILE COVER

(76) Inventor: Hogan M. Hogan, Phoenix, AZ (US)

( * ) Notice: Subject to any disclaimer, the term of this patent is extended or adjusted under 35 U.S.C. 154(b) by 300 days.

(21) Appl. No.: 13/011,887

(22) Filed: Jan. 22, 2011

Related U.S. Application Data

(60) Provisional application No. 61/297,689, filed on Jan. 22, 2010.

(51) Int. Cl.
*F21L 4/00* (2006.01)

(52) U.S. Cl.
USPC ..... 362/183; 362/182; 362/431

(58) Field of Classification Search
USPC ..... 362/183, 431, 363, 184, 249.02, 186, 362/182
See application file for complete search history.

(56) References Cited

U.S. PATENT DOCUMENTS

| | | | | |
|---|---|---|---|---|
| 3,339,065 | A * | 8/1967 | Kelley, Jr. | 362/363 |
| 4,626,852 | A | 12/1986 | Dodge | |
| 4,841,416 | A * | 6/1989 | Doss | 362/183 |
| 5,362,267 | A | 11/1994 | Forrest | |
| 6,021,614 | A | 2/2000 | Krieger | |
| D444,584 | S | 7/2001 | Landefeld | |
| D563,254 | S | 3/2008 | Moore | |
| D590,086 | S | 4/2009 | Laporta | |
| 7,744,248 | B2 * | 6/2010 | Kobinata et al. | 362/249.02 |
| 7,887,214 | B2 * | 2/2011 | Chang et al. | 362/183 |
| 8,292,452 | B2 * | 10/2012 | Ko | 362/183 |
| 8,382,347 | B2 * | 2/2013 | McCanless | 362/431 |
| 2002/0148183 | A1 | 10/2002 | Grant | |
| 2008/0074867 | A1 * | 3/2008 | Chen | 362/183 |

* cited by examiner

*Primary Examiner* – Robert May
(74) *Attorney, Agent, or Firm* — The Luther Law Firm, PLC; Barbara J. Luther

(57) ABSTRACT

A solar powered, illuminated harbor post and pile cover is disclosed that protects a pile from deterioration, prevents bird roosting and droppings as well as other debris, and variably illuminates, beautifies and makes more interesting docks in a harbor. The invention consists of at least one transparent conical cover superimposed over a second base or post cover wherein the interior electronics and LED's are sealed against the environment, weather and other deteriorating elements, yet is simple in manufacture, design, assemblage and repair.

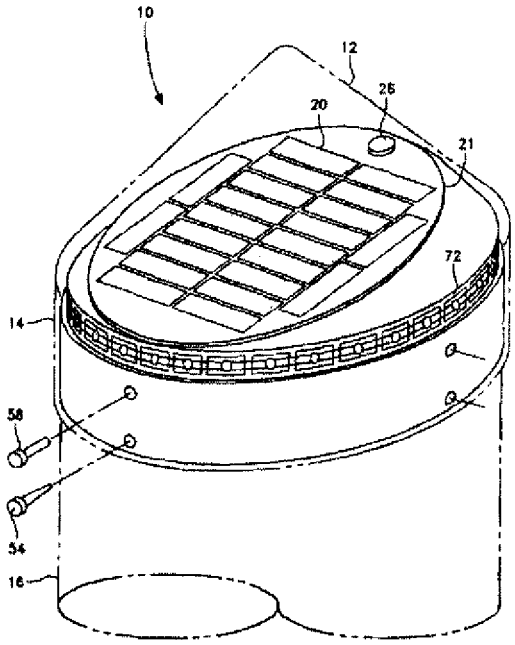

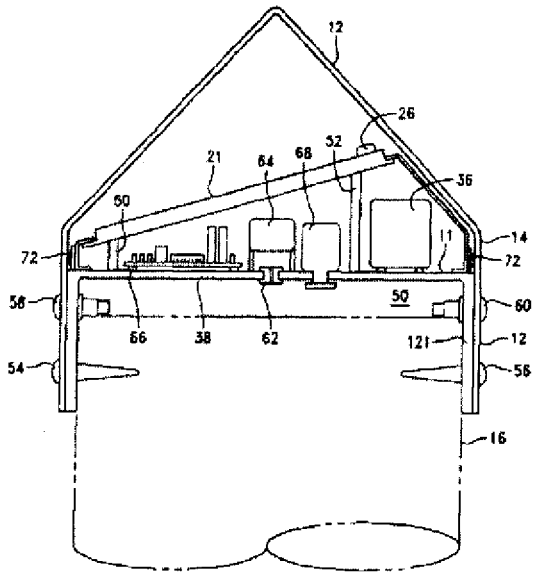

6 Claims, 9 Drawing Sheets